US009201316B2

(12) United States Patent
Yamashita et al.

(10) Patent No.: US 9,201,316 B2
(45) Date of Patent: Dec. 1, 2015

(54) CYLINDRICAL MEMBER, CYLINDRICAL MEMBER FOR IMAGE FORMING APPARATUS, ELECTROPHOTOGRAPHIC PHOTORECEPTOR, IMAGE FORMING APPARATUS, AND PROCESS CARTRIDGE

(71) Applicant: FUJI XEROX CO., LTD., Tokyo (JP)

(72) Inventors: Takayuki Yamashita, Kanagawa (JP); Masaru Agatsuma, Kanagawa (JP); Yoshifumi Shoji, Kanagawa (JP); Hiroki Ando, Kanagawa (JP); Toshiyuki Suto, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 543 days.

(21) Appl. No.: 13/761,804

(22) Filed: Feb. 7, 2013

(65) Prior Publication Data

US 2014/0045109 A1 Feb. 13, 2014

(30) Foreign Application Priority Data

Aug. 10, 2012 (JP) ..... 2012-179072

(51) Int. Cl.

| | |
|---|---|
| ***G03G 5/04*** | (2006.01) |
| ***C22C 21/00*** | (2006.01) |
| ***G03G 15/00*** | (2006.01) |
| ***G03G 5/10*** | (2006.01) |

(52) U.S. Cl.

CPC ..... *G03G 5/04* (2013.01); *G03G 5/102* (2013.01); *G03G 15/75* (2013.01)

(58) Field of Classification Search

CPC ..... G03G 5/04; G03G 5/102; G03G 15/00; G03G 15/75; G03G 21/18

See application file for complete search history.

(56) References Cited

U.S. PATENT DOCUMENTS

2005/0247097 A1 11/2005 Maeda et al.

FOREIGN PATENT DOCUMENTS

| | | |
|---|---|---|
| JP | A-61-044148 | 3/1986 |
| JP | B2-3633287 | 3/2005 |
| JP | B2-3661416 | 6/2005 |
| JP | B2-3871003 | 1/2007 |
| JP | B2-3941238 | 7/2007 |
| JP | B2-4145594 | 9/2008 |

*Primary Examiner* — Lois Zheng

(74) *Attorney, Agent, or Firm* — Oliff PLC

(57) ABSTRACT

A cylindrical member includes aluminum, and has an average area of crystal particles of an outer circumferential surface which is smaller than an average area of crystal particles of an inner circumferential surface.

16 Claims, 9 Drawing Sheets

CYLINDRICAL MEMBER, CYLINDRICAL MEMBER FOR IMAGE FORMING APPARATUS, ELECTROPHOTOGRAPHIC PHOTORECEPTOR, IMAGE FORMING APPARATUS, AND PROCESS CARTRIDGE

CROSS-REFERENCE TO RELATED APPLICATIONS

This application is based on and claims priority under 35 USC 119 from Japanese Patent Application No. 2012-179072 filed Aug. 10, 2012.

BACKGROUND

1. Technical Field

The present invention relates to a cylindrical member, a cylindrical member for an image forming apparatus, an electrophotographic photoreceptor, an image forming apparatus, and a process cartridge.

2. Related Art

Since aluminum or an aluminum alloy has characteristics such as a low weight, a high strength, and high workability, various cylindrical members made of aluminum are used, such as cylindrical containers, e.g., containers for beverages and containers for oil-based pens, and supports of members for image forming apparatuses, e.g., electrophotographic photoreceptors, conductive rolls, and fixing rolls.

SUMMARY

According to an aspect of the invention, there is provided a cylindrical member which includes aluminum and in which an average area of crystal particles of an outer circumferential surface is smaller than an average area of crystal particles of an inner circumferential surface.

BRIEF DESCRIPTION OF THE DRAWINGS

Exemplary embodiments of the present invention will be described in detail based on the following figures, wherein.

DETAILED DESCRIPTION

Figure 1:
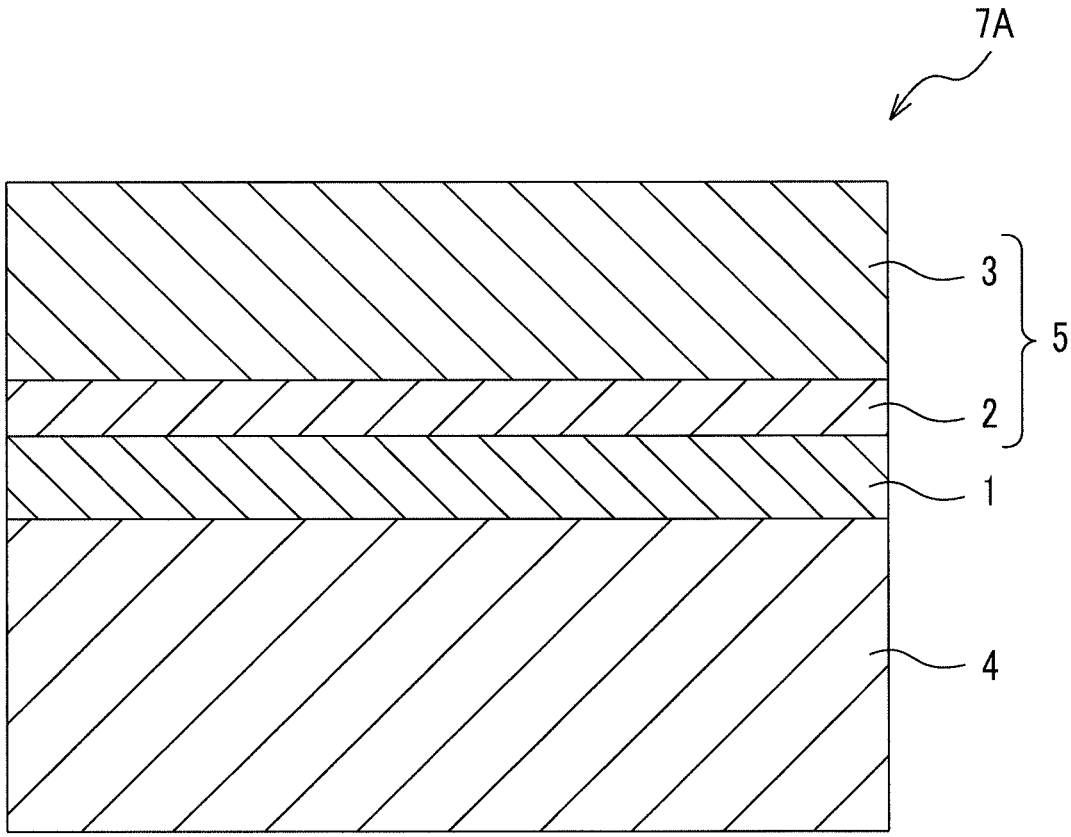
FIG. 1 is a schematic partial cross-sectional view illustrating an example of the configuration of an electrophotographic photoreceptor according to an exemplary embodiment.

Hereinafter, exemplary embodiments of the invention will be described with reference to the accompanying drawings. In the drawings, elements having the same function will be denoted by the same reference numerals and overlapping descriptions will be omitted.

Cylindrical Member

A cylindrical member according to this exemplary embodiment includes aluminum, and an average area of crystal particles of an outer circumferential surface is smaller than an average area of crystal particles of an inner circumferential surface.

The cylindrical member according to this exemplary embodiment is suppressed from being permanently deformed by an external impact. The reason for this is inferred as follows.

Generally, cylindrical members made of aluminum are not easily deformed by an external impact as its hardness is high. However, when the cylindrical members are too hard, these are likely to be permanently deformed when receiving a strong impact.

However, in the cylindrical member according to this exemplary embodiment, crystal particles of the outer circumferential surface are smaller than crystal particles of the inner circumferential surface, and thus it is thought that the outer circumferential surface has high hardness, but the inner circumferential surface has low hardness and is elastically deformed more easily than the outer circumferential surface. Therefore, it is thought that deformation with respect to a relatively weak impact is suppressed due to the small crystal particle structure of the outer circumferential surface, and even when deformation with respect to a strong impact occurs, it is easy to return to the original shape due to the elastic deformation by the large crystal particle structure of the inner circumferential surface.

The use of the cylindrical member according to this exemplary embodiment is not particularly limited. However, since the cylindrical member is unlikely to be permanently deformed, it is suitable as a support. For example, the cylindrical member is suitable for supports of cylindrical members for image forming apparatuses which are used in the image forming apparatuses, cosmetic product cases, battery cases, and the like.

Cylindrical Member for Image Forming Apparatus

Examples of a cylindrical member for an image forming apparatus include a cylindrical member for an image forming apparatus which has the cylindrical member of this exemplary embodiment and a resin layer, a rubber layer, a sponge, or a brush disposed on the outer circumferential surface of the cylindrical member. Specific examples thereof include electrophotographic photoreceptors, conductive rolls, fixing rolls, cleaning sponges roll, cleaning brushes roll, and the like.

Hereinafter, an electrophotographic photoreceptor using the cylindrical member according to this exemplary embodiment as a conductive support will be described as a representative example.

Electrophotographic Photoreceptor

An electrophotographic photoreceptor according to this exemplary embodiment has the cylindrical member (conductive support) according to this exemplary embodiment and a photosensitive layer disposed on the cylindrical member.

FIG. 1 is a schematic cross-sectional view illustrating an example of the layer configuration of an electrophotographic photoreceptor 7A according to this exemplary embodiment. The electrophotographic photoreceptor 7A shown in FIG. 1 has a structure in which an undercoat layer 1, a charge generation layer 2, and a charge transport layer 3 are laminated in this order on a conductive support 4, and the charge generation layer 2 and the charge transport layer 3 constitute a photosensitive layer 5.

FIGS. 2 to 5 are schematic cross-sectional views illustrating other examples of the layer configuration of the electrophotographic photoreceptor according to this exemplary embodiment.

Figure 2:
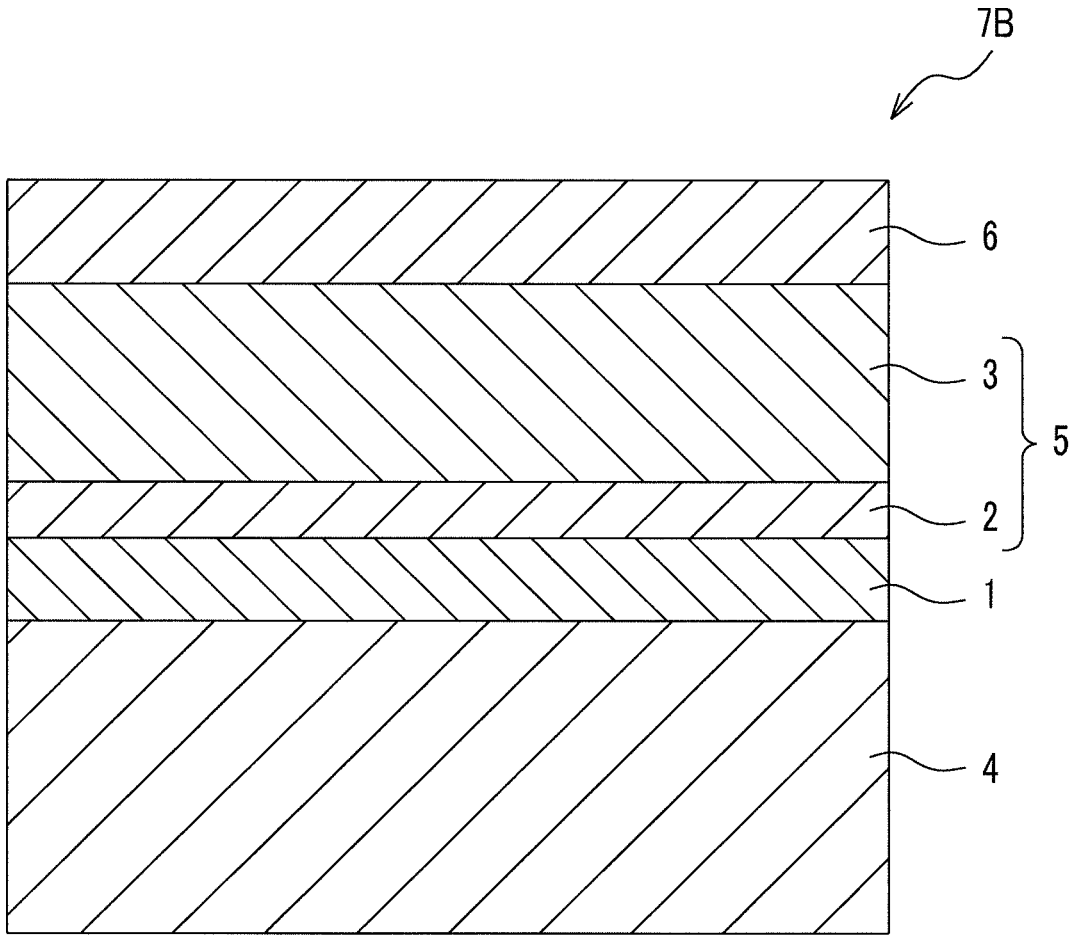
FIG. 2 is a schematic partial cross-sectional view illustrating another example of the configuration of the electrophotographic photoreceptor according to the exemplary embodiment.
Figure 3:
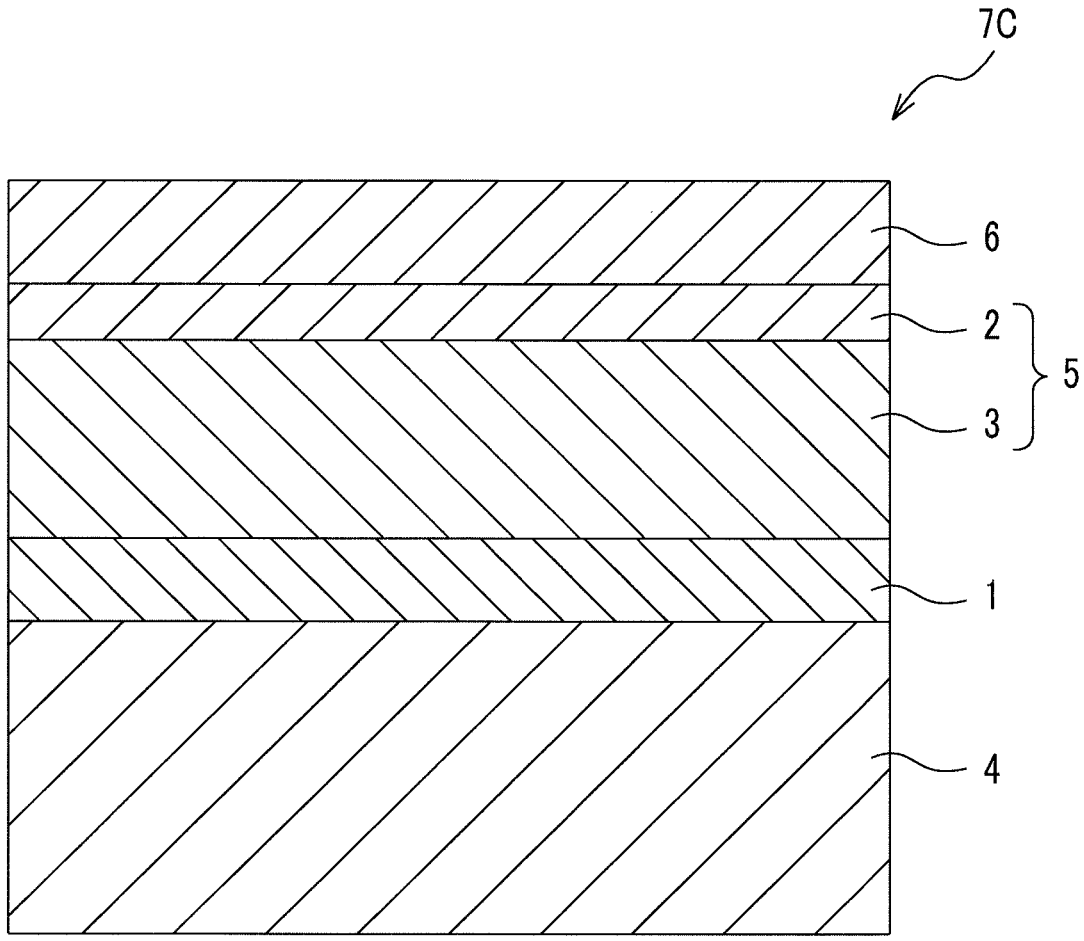
FIG. 3 is a schematic partial cross-sectional view illustrating a further example of the configuration of the electrophotographic photoreceptor according to the exemplary embodiment.

Electrophotographic photoreceptors 7B and 7C shown in FIGS. 2 and 3 are provided with a photosensitive layer 5 in which functions are separated into a charge generation layer 2 and a charge transport layer 3 as in the case of the electrophotographic photoreceptor 7A shown in FIG. 1, and a protective layer 6 is formed as an outermost layer. The electrophotographic photoreceptor 7B shown in FIG. 2 has a structure in which an undercoat layer 1, the charge generation layer 2, the charge transport layer 3, and the protective layer 6 are sequentially laminated on a conductive support 4. The electrophotographic photoreceptor 7C shown in FIG. 3 has a structure in which an undercoat layer 1, the charge transport layer 3, the charge generation layer 2, and the protective layer 6 are sequentially laminated on a conductive support 4.

Figure 4:
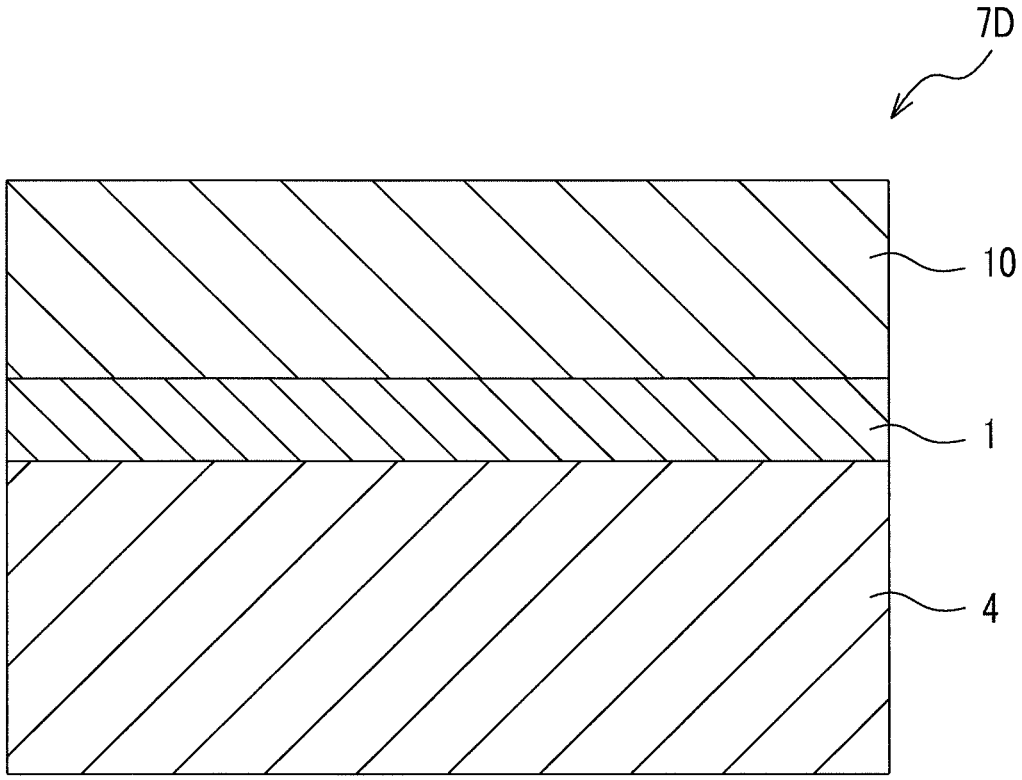
FIG. 4 is a schematic partial cross-sectional view illustrating a still further example of the configuration of the electrophotographic photoreceptor according to the exemplary embodiment.
Figure 5:
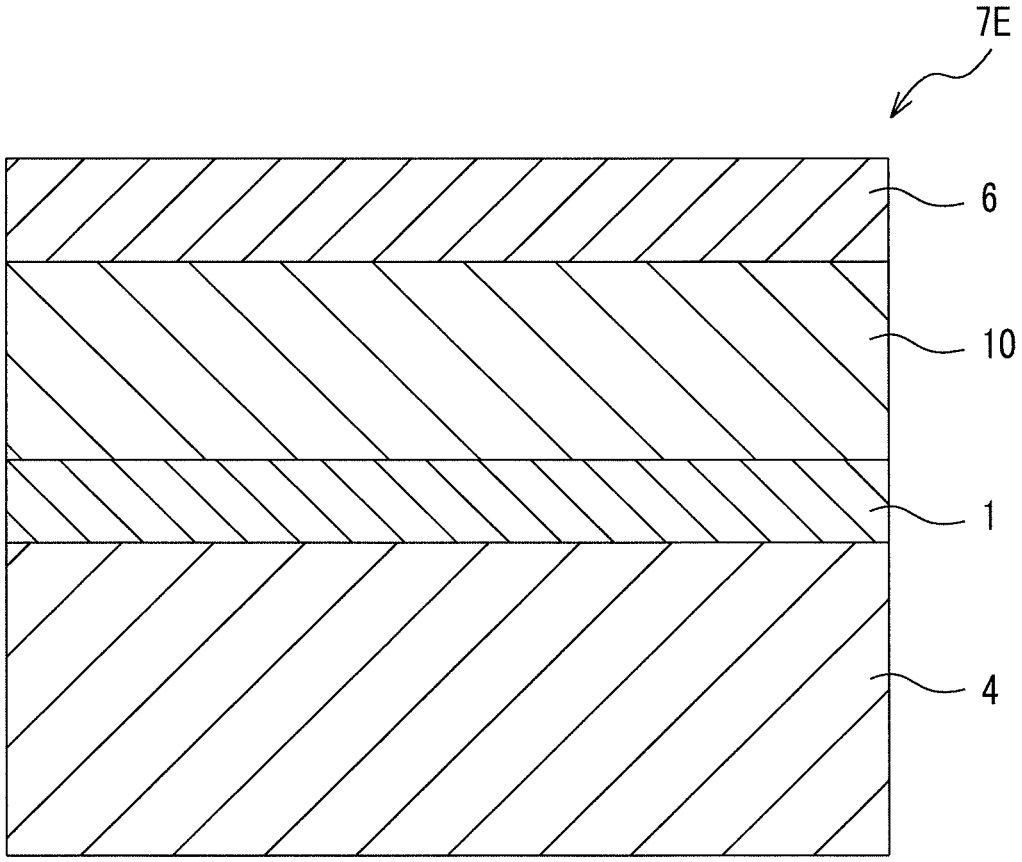
FIG. 5 is a schematic partial cross-sectional view illustrating a still further example of the configuration of the electrophotographic photoreceptor according to the exemplary embodiment.

In electrophotographic photoreceptors 7D and 7E shown in FIGS. 4 and 5, a charge generation material and a charge transport material are contained in the same layer (single layer-type photosensitive layer 10) to integrate the functions. The electrophotographic photoreceptor 7D shown in FIG. 4 has a structure in which an undercoat layer 1 and the single layer-type photosensitive layer 10 are sequentially laminated on a conductive support 4. The electrophotographic photoreceptor 7E shown in FIG. 5 has a structure in which an undercoat layer 1, the single layer-type photosensitive layer 10, and a protective layer 6 are sequentially laminated on a conductive support 4.

In the respective electrophotographic photoreceptors 7A to 7E, the undercoat layer 1 may not be necessarily provided.

Hereinafter, the respective elements will be described on the basis of the electrophotographic photoreceptor 7B shown in FIG. 2. In the following description, the electrophotographic photoreceptor 7 may be addressed when it indicates any of the electrophotographic photoreceptors 7A to 7E shown in FIGS. 2 to 5.

Conductive Support

The conductive support 4 is made of a metal including aluminum (aluminum or aluminum alloy) and an average area of crystal particles of an outer circumferential surface is smaller than an average area of crystal particles of an inner circumferential surface. Here, "conductive" means that the volume resistivity is less than $10^{13}$ Ωcm.

Examples of the aluminum alloy constituting the conductive support 4 include aluminum alloys including Si, Fe, Cu, Mn, Mg, Cr, Zn, and Ti other than aluminum.

The aluminum alloy constituting the conductive support 4 is preferably a so-called 1xxx aluminum group, and from the viewpoint of workability, conductive property, and corrosion resistance, the aluminum content (weight ratio) is preferably 99.5% or greater, and more preferably 99.6% or greater.

A ratio (S1/S2×100) of an average area S1 of crystal particles of the outer circumferential surface to an average area S2 of crystal particles of the inner circumferential surface of the conductive support 4 is preferably from 20% to 45%, and more preferably from 24% to 38%.

Specifically, the average area S1 of the crystal particles of the outer circumferential surface is preferably from 0.9 $\mu m^2$ to 1.25 $\mu m^2$, and the average area S2 of the crystal particles of the inner circumferential surface is preferably from 2.76 $\mu m^2$ to 4.54 $\mu m^2$.

In addition, the average area of the crystal particles of the conductive support 4 preferably decreases in a thickness direction from the inner circumferential surface toward the outer circumferential surface.

In this exemplary embodiment, the areas of the crystal particles are values which are observed and measured by a scanning electron microscope (SEM). The average areas of the crystal particles of the outer circumferential surface and the inner circumferential surface are values obtained by measuring and averaging areas of 12 crystal particles in the outer circumferential surface or the inner circumferential surface of the cylindrical member, and the average area of the crystal particles in the thickness direction is a value obtained by measuring and averaging areas of 12 crystal particles in the surface cut in the thickness direction perpendicular to the axis of the cylindrical member.

The average area of the crystal particles of the conductive support 4 is controlled by a working method, a process after working, and the like.

The method of manufacturing the conductive support 4 of this exemplary embodiment is not particularly limited. However, by combining impact pressing and ironing, the cylindrical conductive support 4 which has a small thickness and in which the average area of crystal particles of the outer circumferential surface is smaller than the average area of crystal particles of the inner circumferential surface is manufactured.

Figure 6A:
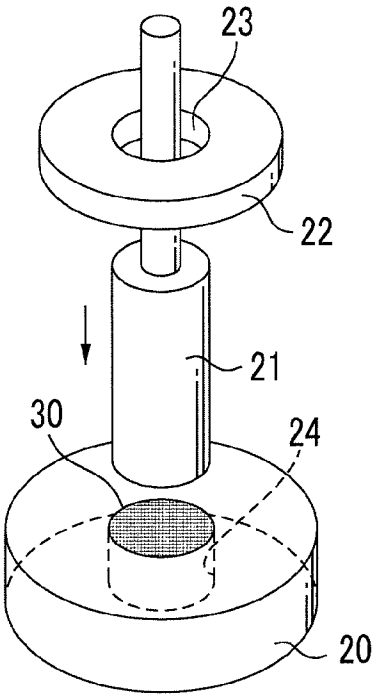
FIGS. 6A to 6C are schematic diagrams illustrating a part of a process of manufacturing a cylindrical member according to the exemplary embodiment (impact pressing)
Figure 6B:
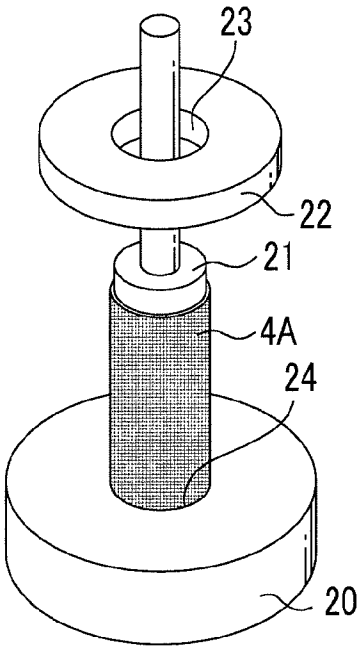
Figure 6C:
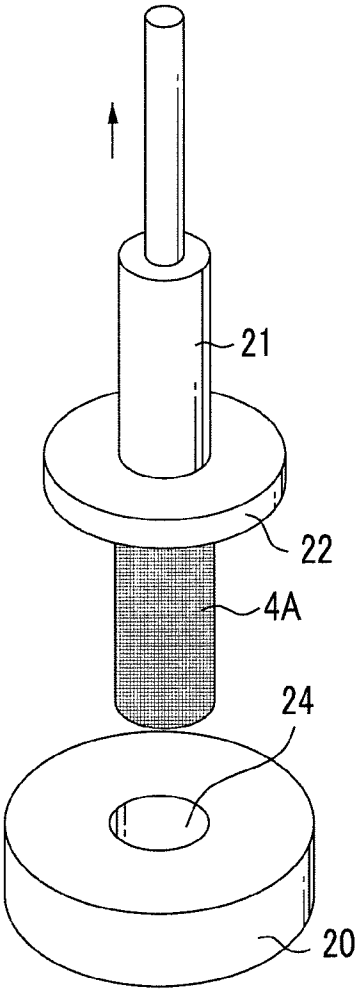
Figure 7B:
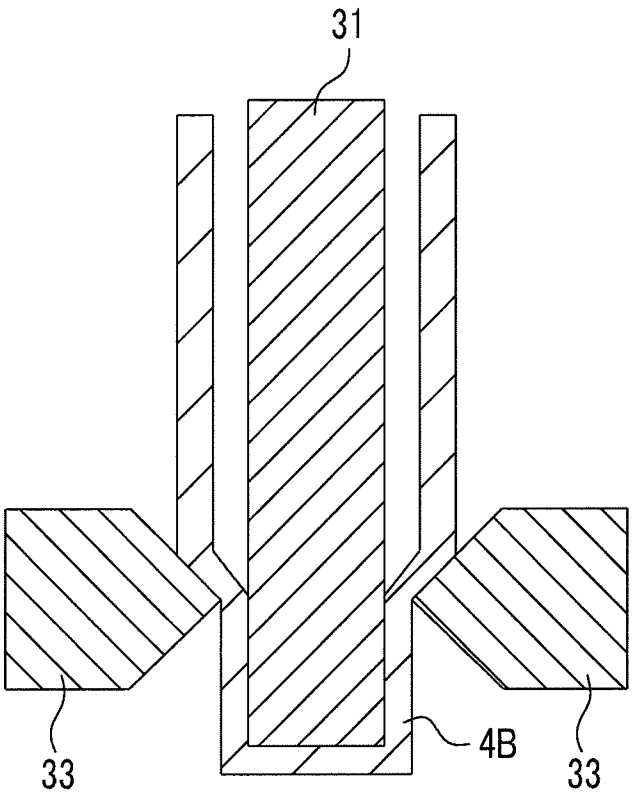
FIGS. 7A and 7B are schematic diagrams illustrating a part of the process of manufacturing the cylindrical member according to the exemplary embodiment (drawing and ironing)
Figure 7A:
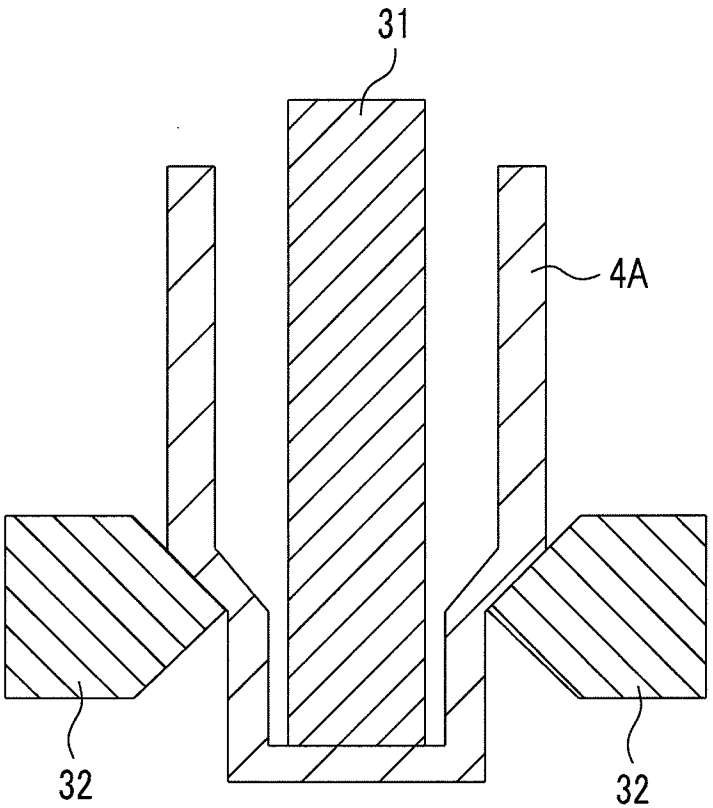

FIGS. 6A to 6C illustrate an example of a process of molding an aluminum or aluminum alloy working material (hereinafter, may be referred to as "slag") into a cylindrical shape by impact pressing, and FIGS. 7A and 7B illustrate an example of a process of manufacturing the conductive support 4 according to this exemplary embodiment by performing ironing on an outer circumferential surface of the cylindrical molded product molded by impact pressing.

Impact Pressing

First, an aluminum or aluminum alloy slag 30 coated with a lubricant (for example, oil) is provided and set in an annular hole 24 which is provided in a die (female die) 20 as shown in FIG. 6A. Next, as shown in FIG. 6B, the slag 30 set in the die 20 is pressed by a cylindrical punch (male die) 21. Accordingly, the slag 30 is molded to be expanded into a cylindrical shape so as to cover the vicinity of the punch 21 from the annular hole of the die 20. After the molding, as shown in FIG. 6C, the punch 21 is lifted to pass through a central hole 23 of a stripper 22, and thus the punch 21 is pulled out and a cylindrical molded product 4A is obtained.

According to such impact pressing, the hardness increases by work hardening and the cylindrical molded product 4A made of aluminum or an aluminum alloy which has a small thickness and high hardness is manufactured.

The thickness of the molded product 4A is not particularly limited. However, from the viewpoint of maintaining the hardness as the conductive support for an electrophotographic photoreceptor and performing working into a thickness of, for example, from 0.3 mm to 0.9 mm by the subsequent ironing, the thickness of the molded product 4A which is molded by impact pressing is preferably from 0.4 mm to 0.8 mm, and more preferably from 0.4 mm to 0.6 mm.

Ironing

Next, if necessary, the cylindrical molded product 4A molded by impact pressing is pushed into a dice 32 from the inside by the cylindrical punch 31 as shown in FIG. 7A so as to be subjected to drawing and the diameter is reduced, and then as shown in FIG. 7B, the molded product is pushed into a dice 33 having a diameter which has been further reduced so as to be subjected to ironing.

The ironing may be performed without the drawing, or may be performed in plural steps. The crystal particles of the outer circumferential surface of the molded product 4B are adjusted in accordance with the number of ironing operations, and generally, the crystal particles are reduced by repeatedly performing the ironing.

In addition, before the ironing, annealing may be performed to release the stress.

The thickness of the molded product 4B after the ironing is preferably from 0.3 mm to 0.9 mm, and more preferably from 0.4 mm to 0.6 mm from the viewpoint of maintaining the hardness as the conductive support for an electrophotographic photoreceptor and suppressing permanent deformation by an external impact.

In this manner, since the molded product 4A is molded by impact pressing and then is subjected to ironing, the cylindrical member (conductive support) 4 which has a small thickness and a low weight and in which the crystal particles of the outer circumferential surface are smaller than the crystal particles of the inner circumferential surface is obtained.

Annealing may be performed as a heat treatment after the working. The sizes of the crystal particles are adjusted in accordance with the temperature and time of annealing.

In addition, when a slag before the working is pre-processed to prepare a slag, a process including rolling into a plate shape for compression, punching into a slag shape, performing homogenization by annealing by heating the slag may be performed.

When the photoreceptor 7 is used in a laser printer, the oscillation wavelength of the laser is preferably from 350 nm to 850 nm, and the shorter the wavelength, the better the resolution. The surface of the conductive support 4 is preferably roughened to have a center line average roughness Ra of from 0.04 μm to 0.5 μm in order to prevent interference fringes from being caused in laser light irradiation. When Ra is 0.04 μm or greater, an effect of preventing the interference is obtained, and when Ra is 0.5 μm or less, a tendency that the image quality roughens is effectively suppressed.

When incoherent light is used as a light source, the roughening for preventing interference fringes is not particularly required. This is more suitable for an increase in lifespan since defects are prevented from being caused by the roughness of the surface of the conductive support 4.

Examples of the roughening method include a wet honing process in which an abrading agent is suspended in water and infused to the support, a centerless grinding process in which the support is brought into pressure contact with a rotating grinding stone and grinding is continuously performed, an anodic oxidation treatment, a method of forming a layer containing organic or inorganic semiconductive particles, and the like.

The anodic oxidation treatment is a process of forming an oxidation film on the surface of aluminum by anodizing the aluminum as an anode in an electrolyte solution. Examples of the electrolyte solution include a sulfuric acid solution, an oxalic acid solution, and the like. However, the porous anodic oxide film as is after the process is chemically active and easily contaminated. In addition, its resistance fluctuation according to the environment is also great. Therefore, the anodic oxide film is preferably subjected to sealing in a manner such that it is treated with a steam under pressure or boiling water (metal salt such as nickel may be added thereto) to be blocked by volume expansion due to a fine hole hydration reaction, thereby being changed to stable hydrated oxide.

The thickness of the anodic oxide film is preferably from 0.3 μm to 15 μm. When the thickness is less than 0.3 μm, the barrier property with respect to injection is poor and thus the effect may be insufficient. In addition, when the thickness is greater than 15 μm, an increase in residual potential due to repeated use may be caused.

The surface of the electrophotographic photoreceptor 7 of this exemplary embodiment may be subjected to a treatment using an acidic treatment liquid or a boehmite treatment.

The treatment using an acidic treatment liquid is performed as follows using an acidic treatment liquid formed of a phosphoric acid, a chromic acid, and a hydrofluoric acid. Regarding the blending ratio of the phosphoric acid, the chromic acid, and the hydrofluoric acid in the acidic treatment liquid, the phosphoric acid is from 10% by weight to 11% by weight, the chromic acid is from 3% by weight to 5% by weight, and the hydrofluoric acid is from 0.5% by weight to 2% by weight. The total concentration of the acids is preferably from 13.5% by weight to 18% by weight. The treatment temperature is from 42° C. to 48° C. A thicker film is formed more rapidly as the treatment temperature is highly maintained. The thickness of the film is preferably from 0.3 μm to 15 μm.

The boehmite treatment is performed by dipping the conductive support 4 in pure water at from 90° C. to 100° C. for from 5 minutes to 60 minutes, or bringing the conductive support 4 into contact with a heated steam at from 90° C. to 120° C. for from 5 minutes to 60 minutes. The thickness of the film is preferably from 0.1 μm to 5 μm. The film may be further anodized using an electrolyte solution having low film solubility such as an adipic acid, a boric acid, borate, phosphate, phthalate, maleate, benzoate, tartrate, and citrate.

Undercoat Layer

The undercoat layer 1 contains an organic metallic compound and a binder resin. Examples of the organic metallic compound include organic zirconium compounds such as a zirconium chelate compound, a zirconium alkoxide compound, and a zirconium coupling agent, organic titanium compounds such as a titanium chelate compound, a titaniumalkoxide compound, and a titanate coupling agent, organic aluminum compounds such as an aluminum chelate compound and an aluminum coupling agent, an antimony alkoxide compound, a germanium alkoxide compound, an indium alkoxide compound, an indium chelate compound, a manganese alkoxide compound, a manganese chelate compound, a tin alkoxide compound, a tin chelate compound, an aluminum silicon alkoxide compound, an aluminum titanium alkoxide compound, an aluminum zirconium alkoxide compound, and the like. Particularly, as the organic metallic compound, organic zirconium compounds, organic titanium compounds, and organic aluminum compounds are preferably used due to a low residual potential and favorable electrophotographic characteristics.

Known binder resins are used as the binder resin constituting the undercoat layer 1, and examples of the binder resin include polyvinyl alcohol, polyvinyl methyl ether, poly-N-vinylimidazole, polyethylene oxide, ethyl cellulose, methyl cellulose, an ethylene-acrylic acid copolymer, polyamide, polyimide, casein, gelatin, polyethylene, polyester, a phenol resin, a vinyl chloride-vinyl acetate copolymer, an epoxy resin, polyvinyl pyrrolidone, polyvinyl pyridine, polyurethane, a polyglutamic acid, a polyacrylic acid, a butyral resin, and the like. The mixing ratio thereof is set as appropriate.

In addition, the undercoat layer 1 may contain a silane coupling agent. Examples of the silane coupling agent include vinyl trichlorosilane, vinyl trimethoxysilane, vinyl triethoxysilane, vinyl tris-2-methoxyethoxysilane, vinyl triacetoxysilane, 3-glycidoxypropyl trimethoxysilane, 3-methacryloxypropyltrimethoxysilane, 3-aminopropyltriethoxysilane, 3-chloropropyltrimethoxysilane, 3-(2-aminoethylamino)propyltrimethoxysilane, 3-mercaptopropyl trimethoxysilane, 3-ureidopropyl triethoxysilane, 2-(3,4-epoxycyclohexyl)trimethoxysilane, and the like.

In addition, an electron transport pigment may be mixed or dispersed in the undercoat layer 1. Examples of the electron transport pigment include organic pigments such as a perylene pigment described in JP-A-47-30330, a bisbenzimidazole perylene pigment, a polycyclic quinone pigment, an indigo pigment, and a quinacridone pigment, organic pigments such as a bisazo pigment and a phthalocyanine pigment having an electron attractant substituent group such as a cyano group, a nitro group, a nitroso group, and a halogen atom, and inorganic pigments such as a zinc oxide and a titanium oxide. Among the pigments, a perylene pigment, a bisbenzimidazole perylene pigment, a polycyclic quinone pigment, a zinc oxide, a titanium oxide are preferably used due to a high electron transfer property.

In addition, the surfaces of the pigments may be treated with the coupling agent, binder resin, or the like in order to control the dispersibility and charge transport property. When the amount of the electron transport pigment is too large, the strength of the undercoat layer is reduced and coating defects are caused. Therefore, the electron transport pigment is used preferably in an amount of 95% by weight or less, and more preferably 90% by weight or less.

The undercoat layer 1 is constituted using a coating liquid for undercoat layer formation which contains the above-described respective constituent materials.

As a method of mixing or dispersing the coating liquid for undercoat layer formation, a usual method using a ball mill, a roll mill, a sand mill, an attritor, ultrasonic waves, or the like are applied. The mixing or dispersing is performed in an organic solvent, but the organic solvent may be any organic solvent, as long as the organic solvent dissolves the organic metallic compound and the binder resin and does not cause gelation or aggregation during mixing or dispersion of the electron transport pigment.

Examples of the organic solvent include general organic solvents such as methanol, ethanol, n-propanol, n-butanol, benzyl alcohol, methyl cellosolve, ethyl cellosolve, acetone, methyl ethyl ketone, cyclohexanone, methyl acetate, n-butyl acetate, dioxane, tetrahydrofuran, methylene chloride, chloroform, chlorobenzene, and toluene. These are used alone or as a mixture of two or more kinds.

In addition, as a coating method which is used when providing the undercoat layer 1, a general method such as a blade coating method, a Meyer bar (wire bar) coating method, a spray coating method, a dip coating method, a bead coating method, an air knife coating method, or a curtain coating method is used.

After the coating, the coating film is dried and thus the undercoat layer is obtained. However, generally, the drying is performed at a temperature at which the solvent is evaporated to form a film. Particularly, the conductive support 4 subjected to the acidic solution treatment and the boehmite treatment is likely to hide its defects insufficiently, and thus the undercoat layer 1 is preferably formed.

The thickness of the undercoat layer 1 is preferably from 0.1 μm to 30 μm, and more preferably from 0.2 μm to 25 μm.

Charge Generation Layer

The charge generation layer 2 contains a charge generation material, or contains a charge generation material and a binder resin.

As the charge generation material, known charge generation materials are used. Examples of the known charge generation material include azo pigments such as bisazo and trisazo, condensed-ring aromatic pigments such as dibromoanthanthrone, organic pigments such as perylene pigments, pyrrolo pyrrol pigments, and phthalocyanine pigments, and inorganic pigments such as trigonal selenium and a zinc oxide. When a light source having an exposure wavelength of from 380 nm to 500 nm is used, inorganic pigments are preferable as the charge generation material, and when a light source having an exposure wavelength of from 700 nm to 800 nm is used, metallic and nonmetallic phthalocyanine pigments are preferable as the charge generation material. Among them, hydroxygallium phthalocyanine disclosed in JP-A-5-263007 and JP-A-5-279591, chlorogallium phthalocyanine disclosed in JP-A-5-98181, dichlorotin phthalocyanine disclosed in JP-A-5-140472 and JP-A-5-140473, and titanyl phthalocyanine disclosed in JP-A-4-189873 and JP-A-5-43813 are particularly preferable.

In addition, as the charge generation material, hydroxygallium phthalocyanine having diffraction peaks at Bragg angles ($2\theta \pm 0.2°$) of 7.5°, 9.9°, 12.5°, 16.3°, 18.6°, 25.1°, and 28.3° with respect to CuKα characteristic X-rays, titanyl phthalocyanine having a strong diffraction peak at a Bragg angle ($2\theta \pm 0.2°$) of 27.2° with respect to CuKα characteristic X-rays, chlorogallium phthalocyanine having strong diffraction peaks at Bragg angles ($2\theta \pm 0.2°$) of 7.4°, 16.6°, 25.5°, and 28.3° with respect to CuKα characteristic X-rays are also preferable.

The binder resin constituting the charge generation layer 2 is selected from a variety of insulating resins. In addition, the binder resin may be selected from organic photoconductive polymers such as poly-N-vinylcarbazole, polyvinyl anthracene, polyvinyl pyrene, and polysilane. Preferable examples of the binder resin include, but are not limited to, insulating resins such as a polyvinyl butyral resin, a polyarylate resin (for example, polycondensates of bisphenols and aromatic divalent carboxylic acids such as a polycondensate of bisphenol A and a phthalic acid), a polycarbonate resin, a polyester resin, a phenoxy resin, a vinyl chloride-vinyl acetate copolymer, a polyamide resin, an acrylic resin, a polyacrylamide resin, a polyvinylpyridine resin, a cellulose resin, a urethane resin, an epoxy resin, casein, a polyvinyl alcohol resin, and a polyvinylpyrrolidone resin. These binder resins may be used alone or as a mixture of two or more kinds.

The charge generation layer 2 is formed through deposition using the charge generation material, or formed using a coating liquid for charge generation layer formation containing the charge generation material and a binder resin.

The blending ratio (weight ratio) of the charge generation material and the binder resin in the coating liquid for charge generation layer formation is preferably from 10:1 to 1:10. In addition, as a method of dispersing the charge generation material and the binder resin, a usual method such as a ball mill dispersion method, an attritor dispersion method, or a sand mill dispersion method is used. According to these dispersion methods, a change in crystal form of the charge generation material due to the dispersion is suppressed.

Furthermore, in the dispersion, it is effective to adjust the particle size to preferably 0.5 μm or less, more preferably 0.3 μm or less, and even more preferably 0.15 μm or less.

Examples of the solvent which is used in the dispersion include general organic solvents such as methanol, ethanol, n-propanol, n-butanol, benzyl alcohol, methyl cellosolve, ethyl cellosolve, acetone, methyl ethyl ketone, cyclohexanone, methyl acetate, n-butyl acetate, dioxane, tetrahydrofuran, methylene chloride, chloroform, chlorobenzene, and toluene. These are used alone or as a mixture of two or more kinds.

As a coating method which is used when providing the charge generation layer 2, a general method such as a blade coating method, a Meyer bar coating method, a spray coating method, a dip coating method, a bead coating method, an air knife coating method, or a curtain coating method is used.

The thickness of the charge generation layer 2 is preferably from 0.1 μm to 5 μm, and more preferably from 0.2 μm to 2.0 μm.

Charge Transport Layer

The charge transport layer 3 contains a charge transport material and a binder resin, or contains a polymeric charge transport material.

Examples of the charge transport material include, but are not limited to, electron transport compounds such as quinone-based compounds, e.g., p-benzoquinone, chloranil, bromanil, and anthraquinone, tetracyanoquinodimethane-based compounds, fluorenone compounds, e.g., 2,4,7-trinitrofluorenone, xanthone-based compounds, benzophenone-based compounds, cyanovinyl-based compounds, and ethylene-based compounds, and hole transport compounds such as triarylamine-based compounds, benzidine-based compounds, arylalkane-based compounds, aryl-substituted ethylene-based compounds, stilbene-based compounds, anthracene-based compound, and hydrazone-based compounds. These charge transport materials are used alone or as a mixture of two or more kinds.

In addition, as the charge transport material, a compound represented by the following Formula (a-1), (a-2) or (a-3) is preferable from the viewpoint of mobility.

(a-1)

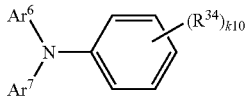

In the Formula (a-1), $R^{34}$ represents a hydrogen atom or a methyl group, and k10 represents 1 or 2. In addition, $Ar^6$ and $Ar^7$ each represent a substituted or unsubstituted aryl group, $—C_6H_4—C(R^{38})=C(R^{39})(R^{40})$, or $—C_6H_4—CH=CH—CH=C(Ar)_2$, and examples of a substituent group include a halogen atom, an alkyl group having 1 to 5 carbon atoms, an alkoxy group having 1 to 5 carbon atoms, and a substituted amino group substituted with an alkyl group having 1 to 3 carbon atoms. $R^{38}$, $R^{39}$, and $R^{40}$ each represent a hydrogen atom, a substituted or unsubstituted alkyl group, or a substituted or unsubstituted aryl group, and Ar represents a substituted or unsubstituted aryl group.

(a-2)

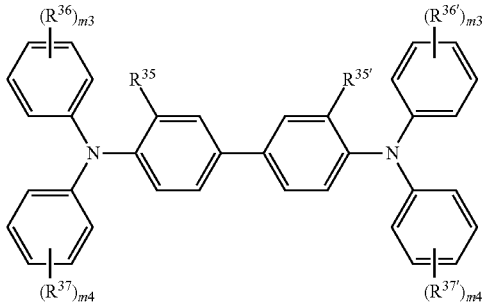

In the Formula (a-2), $R^{35}$ and $R^{35'}$ each independently represent a hydrogen atom, a halogen atom, an alkyl group having 1 to 5 carbon atoms, or an alkoxy group having 1 to 5 carbon atoms, $R^{36}$, $R^{36'}$, $R^{37}$, and $R^{37'}$ each independently represent a halogen atom, an alkyl group having 1 to 5 carbon atoms, an alkoxy group having 1 to 5 carbon atoms, an amino group substituted with an alkyl group having 1 to 2 carbon atoms, a substituted or unsubstituted aryl group, $—C(R^{38})=C(R^{39})(R^{40})$, or $—CH=CH—CH=C(Ar)_2$, $R^{38}$, $R^{39}$, and $R^{40}$ each independently represent a hydrogen atom, a substituted or unsubstituted alkyl group, or a substituted or unsubstituted aryl group, and Ar represents a substituted or unsubstituted aryl group. m3 and m4 each independently represent an integer of from 0 to 2.

(a-3)

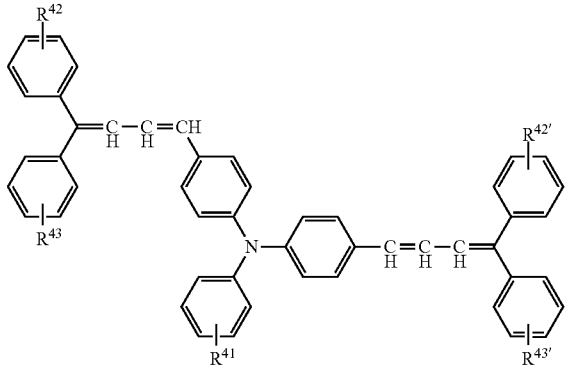

In the Formula (a-3), $R^{41}$ represents a hydrogen atom, an alkyl group having 1 to 5 carbon atoms, an alkoxy group having 1 to 5 carbon atoms, a substituted or unsubstituted aryl group, or $—CH=CH—CH=C(Ar)_2$. Ar represents a substituted or unsubstituted aryl group. $R^{42}$, $R^{42'}$, $R^{43}$, and $R^{43'}$ each independently represent a hydrogen atom, a halogen atom, an alkyl group having 1 to 5 carbon atoms, an alkoxy group having 1 to 5 carbon atoms, an amino group substituted with an alkyl group having 1 to 2 carbon atoms, or a substituted or unsubstituted aryl group.

Examples of the binder resin constituting the charge transport layer 3 include a polycarbonate resin, a polyester resin, a methacrylic resin, an acrylic resin, a polyvinyl chloride resin, a polyvinylidene chloride resin, a polystyrene resin, a polyvinyl acetate resin, a styrene butadiene copolymer, a vinylidene chloride-acrylonitrile copolymer, a vinyl chloride-vinyl acetate copolymer, a vinyl chloride-vinyl acetate-maleic anhydride copolymer, a silicone resin, a silicone-alkyd resin, a phenol-formaldehyde resin, a styrene-alkyd resin, poly-N-vinyl carbazole, polysilane, and polymeric charge transport materials such as polyester-based polymeric charge transport materials disclosed in JP-A-8-176293 and JP-A-8-208820. These binder resins are used alone or as a mixture of two or more kinds. The blending ratio (weight ratio) of the charge transport material and the binder resin is preferably from 10:1 to 1:5.

In addition, the polymeric charge transport materials may be used alone. As the polymeric charge transport material, known materials having a charge transport property such as poly-N-vinylcarbazole and polysilane are used. Particularly, polyester-based polymeric charge transport materials disclosed in JP-A-8-176293 and JP-A-8-208820 are particularly preferable since these have a high charge transport property. The polymeric charge transport material itself is usable as a charge transport layer. However, it may be mixed with the binder resin to form a film.

The charge transport layer 3 is formed using a coating liquid for charge transport layer formation which contains the above-described constituent materials. Examples of a solvent which is used in the coating liquid for charge transport layer formation include general organic solvents such as aromatic hydrocarbons, e.g., benzene, toluene, xylene, and chlorobenzene, ketones, e.g., acetone and 2-butanone, halogenated aliphatic hydrocarbons, e.g., methylene chloride, chloroform, and ethylene chloride, and cyclic or linear ethers, e.g., tetrahydrofuran and ethyl ether. These are used alone or as a mixture of two or more kinds. In addition, as a method of dispersing the above-described respective constituent materials, known methods are used.

As a coating method which is used when coating the charge generation layer 2 with the coating liquid for charge transport layer formation, a general method such as a blade coating method, a Meyer bar coating method, a spray coating method, a dip coating method, a bead coating method, an air knife coating method, or a curtain coating method is used.

The thickness of the charge transport layer 3 is preferably from 5 μm to 50 μm, and more preferably from 10 μm to 30 μm.

Protective Layer

The protective layer 6 is provided on the photosensitive layer if necessary. The protective layer is provided to, for example, prevent chemical changes of the charge transport layer in the photoreceptor having a lamination structure when being charged, or to further improve the mechanical strength of the photosensitive layer.

Therefore, as the protective layer 6, a layer including a crosslinked material (cured material) may be preferably applied. Examples thereof include known structures such as a cured layer of a composition including a reactive charge transport material, and if necessary, a curable resin, and a cured layer in which a charge transport material is dispersed in a curable resin. In addition, the protective layer may be constituted by a layer in which a charge transport material is dispersed in a binder resin.

The protective layer 6 is formed using a coating liquid for protective layer formation in which the above-described components are added to a solvent.

As a method of coating the charge generation layer with the coating liquid for protective layer formation, a general method such as a dip coating method, a push-up coating method, a Meyer bar coating method, a spray coating method, a blade coating method, a knife coating method, or a curtain coating method is used.

The thickness of the protective layer 6 is set in the range of, for example, preferably from 1 μm to 20 μm, and more preferably from 2 μm to 10 μm.

Single Layer-Type Photosensitive Layer

The single layer-type photosensitive layer (charge generation/charge transport layer) includes, for example, a binder resin, a charge generation material, and a charge transport material. These materials are the same as those in the descriptions of the charge generation layer and the charge transport layer.

In the single layer-type photosensitive layer, the content of the charge generation material is preferably from 10% by weight to 85% by weight, and more preferably from 20% by weight to 50% by weight. In addition, the content of the charge transport material is preferably from 5% by weight to 50% by weight.

The method of forming the single layer-type photosensitive layer is the same as the method of forming the charge generation layer or the charge transport layer. The thickness of the single layer-type photosensitive layer is preferably from 5 μm to 50 μm, and more preferably 10 μm to 40 μm.

Others

In the electrophotographic photoreceptor according to this exemplary embodiment, additives such as an antioxidant, a light stabilizer, and a thermal stabilizer may be added to the photosensitive layer and the protective layer in order to prevent a deterioration of the photoreceptor due to ozone or oxidized gas generated in an image forming apparatus, or light and heat.

In addition, at least one kind of electron-accepting substance may be added to the photosensitive layer and the protective layer in order to improve sensitivity, reduce a residual potential, and reduce fatigue upon repeated use.

In addition, silicone oil as a leveling agent may be added to the coating liquids which form the respective layers to improve smoothness of the coating films in the photosensitive layer and the protective layer.

Process Cartridge and Image Forming Apparatus

Next, a process cartridge and an image forming apparatus using the electrophotographic photoreceptor of this exemplary embodiment will be described.

The process cartridge of this exemplary embodiment is provided with the cylindrical member for an image forming apparatus of this exemplary embodiment, and has a configuration which is provided with, for example, an electrophotographic photoreceptor as the cylindrical member for an image forming apparatus of this exemplary embodiment and is detachable from the image forming apparatus.

In addition, the image forming apparatus of this exemplary embodiment is provided with the cylindrical member for an image forming apparatus of this exemplary embodiment, and is provided with, for example, an electrophotographic photoreceptor constituted by the cylindrical member for an image forming apparatus of this exemplary embodiment, a charging unit that charges the surface of the electrophotographic photoreceptor, an electrostatic latent image forming unit that forms an electrostatic latent image on the surface of a charged electrophotographic photoreceptor, a developing unit that develops the electrostatic latent image formed on the surface of the electrophotographic photoreceptor with a developer including a toner to form a toner image, and a transfer unit that transfers the toner image formed on the surface of the electrophotographic photoreceptor onto a recording medium.

The image forming apparatus of this exemplary embodiment may be a so-called tandem apparatus having plural photoreceptors corresponding to respective color toners, and in this case, all of the photoreceptors are preferably the electrophotographic photoreceptors of this exemplary embodiment. In addition, the transfer of the toner image may be performed in an intermediate transfer manner using an intermediate transfer member.

Figure 8:
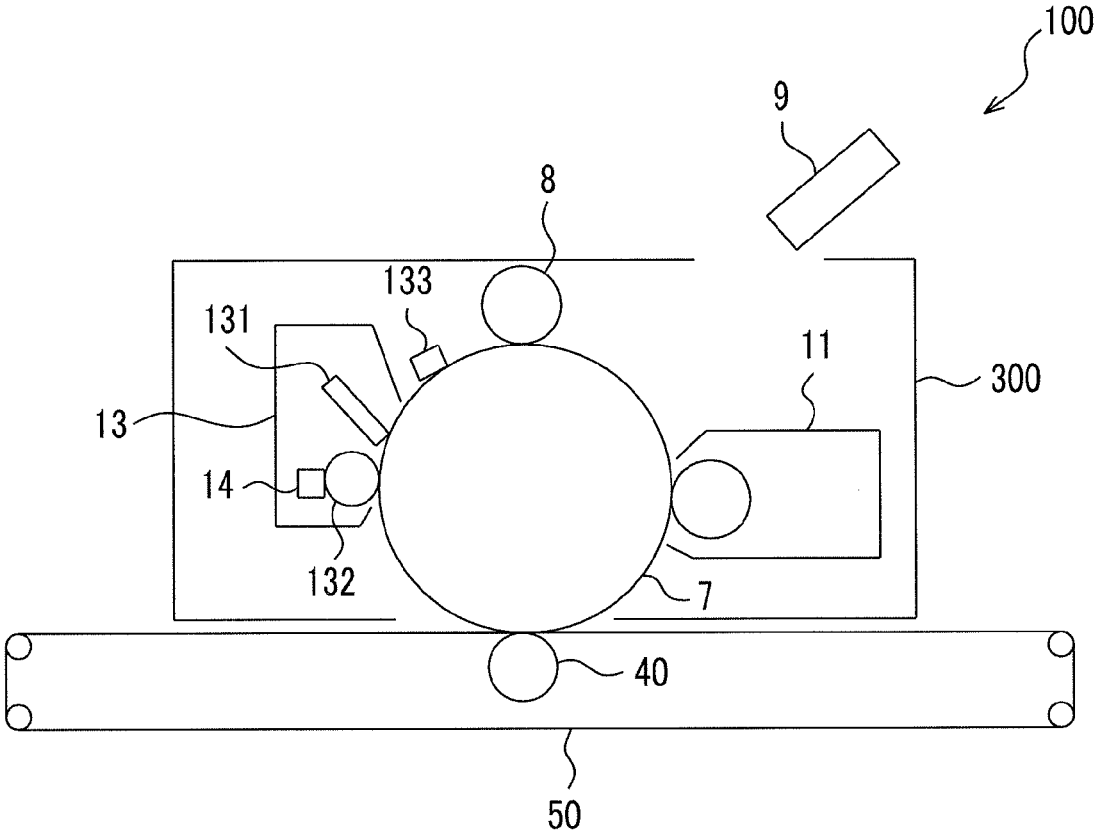
FIG. 8 is a schematic diagram illustrating the configuration of an example of an image forming apparatus according to the exemplary embodiment.

FIG. 8 is a schematic diagram illustrating the configuration of an example of the image forming apparatus according to this exemplary embodiment. As shown in FIG. 8, an image forming apparatus 100 is provided with a process cartridge 300 provided with an electrophotographic photoreceptor 7, an exposure device 9, a transfer device 40, and an intermediate transfer member 50. In the image forming apparatus 100, the exposure device 9 is disposed at such a position as to expose the electrophotographic photoreceptor 7 from an opening of the process cartridge 300, the transfer device 40 is disposed at such a position as to be opposed to the electrophotographic photoreceptor 7 with the intermediate transfer member 50 interposed therebetween, and the intermediate transfer member 50 is disposed so as to be partially brought into contact with the electrophotographic photoreceptor 7.

The process cartridge 300 constituting a part of the image forming apparatus 100 shown in FIG. 8 supports the electrophotographic photoreceptor 7, a charging device 8 (example of charging unit), a developing device 11 (example of developing unit), and a cleaning device 13 (example of toner removing unit) integrally in a housing. The cleaning device 13 has a cleaning blade 131 (cleaning member), and the cleaning blade 131 is disposed to be brought into contact with the surface of the photoreceptor 7 so as to remove the toner remaining on the surface of the electrophotographic photoreceptor 7.

The cleaning device 13 as shown is an example using a fibrous member 132 (roll shape) which supplies an antifriction 14 to the surface of the photoreceptor 7 and a fibrous member 133 (flat brush) which assists the cleaning other than the cleaning blade 131. However, these may be used or may not be used.

As the charging device 8, for example, a contact-type charger using a conductive or semiconductive charging roller, charging brush, charging film, charging rubber blade, charging tube, or the like is used. In addition, known chargers such as a noncontact-type roller charger and a scorotron or corotron charger using a corona discharge are also used.

Although not shown in the drawing, a photoreceptor heating member for increasing the temperature of the electrophotographic photoreceptor 7 and reducing a relative temperature may be provided around the electrophotographic photoreceptor 7.

Examples of the exposure device 9 (example of electrostatic latent image forming unit) include optical equipment which exposes the surface of the photoreceptor 7 with light such as semiconductor laser light, LED light, or liquid crystal shutter light in the form of a predetermined image. The wavelength of the light source is in the spectral sensitivity region of the photoreceptor. As for the wavelength of the semiconductor laser, for example, a near-infrared laser having an oscillation wavelength of approximately 780 nm is predominantly used. However, the wavelength is not limited thereto, and a laser having an oscillation wavelength of 600 nm to less than 700 nm or a laser having an oscillation wavelength of from about 400 nm to about 450 nm as a blue laser may also be used. In addition, it is also effective to use a surface-emitting laser light source that is capable of outputting multi beams in order to form a color image.

As the developing device 11, for example, a general developing device, which performs developing with or without the contact of a magnetic or nonmagnetic single-component developer or two-component developer, may be used. The developing device is not particularly limited as long as it has the above-described function, and is selected according to the purpose. For example, known developing units, which have a function of adhering the single-component developer or two-component developer to the electrophotographic photoreceptor 7 using a brush, a roller, or the like, may be used. Among them, a developing device employing a developing roller of which the surface holds a developer is preferably used.

Hereinafter, a toner which is used in the developing device 11 will be described.

The average shape factor $((ML^2/A)\times(\pi/4)\times100$, where ML represents a maximum length of the particle and A represents a projected area of the particle) of the toner which is used in the image forming apparatus of this exemplary embodiment is preferably from 100 to 150, more preferably from 105 to 145, and even more preferably from 110 to 140. Furthermore, a volume average particle diameter of the toner is preferably from 3 μm to 12 μm, and more preferably from 3.5 μm to 9 μm.

Although the toner is not particularly limited by a manufacturing method, a toner is used which is manufactured by, for example, a kneading and pulverizing method in which a binder resin, a colorant, a release agent, and optionally, a charge-controlling agent and the like are added, and the resultant mixture is kneaded, pulverized and classified; a method in which the shapes of the particles obtained through the kneading and pulverizing method are changed by a mechanical impact force or thermal energy; an emulsion polymerization and aggregation method in which polymerizable monomers of a binder resin are subjected to emulsion polymerization, and the formed resultant dispersion and a dispersion of a colorant, a release agent, and optionally, a charge-controlling agent and the like are mixed, aggregated, and heat-melted to obtain toner particles; a suspension polymerization method in which polymerizable monomers for obtaining a binder resin, a colorant, a release agent, and optionally, a solution such as a charge-controlling agent are suspended in an aqueous solvent and polymerized; or a dissolution and suspension method in which a binder resin, a colorant, a release agent, and optionally, a solution such as a charge-controlling agent are suspended in an aqueous solvent and granulated.

In addition, known methods such as a manufacturing method in which the toner obtained through one of the above methods is used as a core to achieve a core shell structure by further making aggregated particles adhere to the toner and by coalescing them with heating are used. As the toner manufacturing method, a suspension polymerization method, an emulsion polymerization and aggregation method, and a dissolution and suspension method, all of which are used to manufacture the toner using an aqueous solvent, are preferable, and an emulsion polymerization and aggregation method is particularly preferable from the viewpoint of controlling the shape and the particle size distribution.

The toner particles preferably contain a binder resin, a colorant, and a release agent, and may further contain silica or a charge-controlling agent.

Examples of the binder resin which is used in the toner particles include homopolymers and copolymers of styrenes such as styrene and chlorostyrene, monoolefins such as ethylene, propylene, butylene, and isoprene, vinyl esters such as vinyl acetate, vinyl propionate, vinyl benzoate, and vinyl butyrate, α-methylene aliphatic monocarboxylic acid esters such as methyl acrylate, ethyl acrylate, butyl acrylate, dodecyl acrylate, octyl acrylate, phenyl acrylate, methyl methacrylate, ethyl methacrylate, butyl methacrylate, and dodecyl methacrylate, vinyl ethers such as vinyl methyl ether, vinyl ethyl ether, and vinyl butyl ether, and vinyl ketones such as vinyl methyl ketone, vinyl hexyl ketone, and vinyl isopropenyl ketone, polyester resins formed by copolymerization of dicarboxylic acids and diols, and the like.

Particularly representative examples of the binder resin include polystyrene, a styrene-alkyl acrylate copolymer, a styrene-alkyl methacrylate copolymer, a styrene-acrylonitrile copolymer, a styrene-butadiene copolymer, a styrene-maleic anhydride copolymer, polyethylene, polypropylene, a polyester resin, and the like. Further examples of the binder resin include polyurethane, an epoxy resin, a silicone resin, polyamide, modified rosin, and paraffin wax.

Representative examples of the colorant include magnetic powders such as magnetite and ferrite, carbon black, aniline blue, calcoil blue, chrome yellow, ultramarine blue, Du Pont oil red, quinoline yellow, methylene blue chloride, phthalocyanine blue, malachite green oxalate, lamp black, Rose Bengal, C. I. Pigment Red 48:1, C. I. Pigment Red 122, C. I. Pigment Red 57:1, C. I. Pigment Yellow 97, C. I. Pigment Yellow 17, C. I. Pigment Blue 15:1, C. I. Pigment Blue 15:3, and the like.

Representative examples of the release agent include low-molecular-weight polyethylene, low-molecular-weight polypropylene, Fischer-Tropsch wax, montan wax, carnauba wax, rice wax, candelilla wax, and the like.

As the charge-controlling agent, known charge controlling agents are used. For example, an azo-based metal complex compound, a metal complex compound of salicylic acid, or a polar group-containing resin-type charge-controlling agent is used. When the toner is manufactured by a wet manufacturing method, a material which has poor water solubility is preferably used. In addition, the toner may be either a magnetic toner containing a magnetic material or a nonmagnetic toner containing no magnetic material.

The toner which is used in the developing device 11 is manufactured by mixing the toner particles with the external additives with a Henschel mixer or a V-blender. Moreover, when the toner particles are manufactured by a wet process, the additives may be externally added as well by a wet process.

Lubricating particles may be added to the toner which is used in the developing device 11. Examples of the lubricating particles include solid lubricants such as graphite, molybdenum disulfide, talc, fatty acids, and fatty acid metallic salts, low-molecular-weight polyolefins such as polypropylene, polyethylene, and polybutene, silicones which are softened by heating, aliphatic amides such as oleamide, erucamide, ricinoleic acid amide, and stearamide, vegetable waxes such as carnauba wax, rice wax, candelilla wax, Japan wax, and jojoba oil, animal waxes such as beeswax, mineral and petroleum waxes such as montan wax, ozocerite, ceresine, paraffin wax, microcrystalline wax, and Fischer-Tropsch wax, and modified products thereof. These may be used alone or in combination with two or more kinds.

The average particle diameter is preferably from 0.1 μm to 10 μm. The particle diameter may be equalized by pulverizing the products having the above-described chemical structure.

The amount of the lubricating particles added to the toner is preferably from 0.05% by weight to 2.0% by weight, and more preferably from 0.1% by weight to 1.5% by weight.

Inorganic particles, organic particles, composite particles formed by making inorganic particles adhere to organic particles, or the like may be added to the toner which is used in the developing device 11.

Suitable examples of the inorganic particles include various kinds of inorganic oxides, nitrides, and borides, such as silica, alumina, titania, zirconia, barium titanate, aluminum titanate, strontium titanate, magnesium titanate, zinc oxide, chromium oxide, cerium oxide, antimony oxide, tungsten oxide, tin oxide, tellurium oxide, manganese oxide, boron oxide, silicon carbide, boron carbide, titanium carbide, silicon nitride, titanium nitride, and boron nitride.

The inorganic particles may be treated with a titanium coupling agent such as tetrabutyl titanate, tetraoctyl titanate, isopropyltriisostearoyl titanate, isopropyltridecylbenzenesulfonyl titanate, or bis(dioctylpyrophosphate)oxyacetate titanate, or a silane coupling agent such as 3-(2-aminoethyl) aminopropyltrimethoxysilane, 3-(2-aminoethyl)aminopropylmethyldimethoxysilane, 3-methacryloxypropyltrimethoxysilane, N-2-(N-vinylbenzylaminoethyl)-3-aminopropyltrimethoxysilane hydrochloride, hexamethyldisilazane, methyltrimethoxysilane, butyltrimethoxysilane, isobutyltrimethoxysilane, hexyltrimethoxysilane, octyltrimethoxysilane, decyltrimethoxysilane, dodecyltrimethoxysilane, phenyltrimethoxysilane, o-methylphenyltrimethoxysilane, or p-methylphenyltrimethoxysilane. In addition, inorganic particles subjected to a hydrophobization treatment with silicone oil, or higher fatty acid metallic salt such as aluminum stearate, zinc stearate, or calcium stearate are also preferably used.

Examples of the organic particles include styrene resin particles, styrene-acrylic resin particles, polyester resin particles, urethane resin particles, and the like.

As for the particle diameter of the particles used, the number average particle diameter is preferably from 5 nm to 1000 nm, more preferably from 5 nm to 800 nm, and even more preferably from 5 nm to 700 nm.

The sum of the amount of the above-described particles added and the amount of the lubricating particles added is preferably 0.6% by weight or greater.

As other inorganic oxides added to the toner, it is preferable to use small-diameter inorganic oxides having a primary particle diameter of 40 nm or less, and further to add larger-diameter inorganic oxides. As the inorganic oxide particles, known inorganic oxide particles are used, but silica and titanium oxide are preferably used in combination.

In addition, small-diameter inorganic particles may be subjected to a surface treatment. Furthermore, carbonates such as calcium carbonate and magnesium carbonate and inorganic minerals such as hydrotalcite are also preferably added.

In addition, an electrophotographic color toner is used in mixture with a carrier. Examples of the carrier include an iron powder, glass beads, a ferrite powder, a nickel powder, and powders obtained by coating the surfaces of the above powders with a resin. The mixing ratio between the toner and the carrier is set in accordance with the need.

Examples of the transfer device 40 (example of transfer unit) include known transfer chargers such as contact-type transfer chargers using a belt, a roller, a film, a rubber blade, or the like, scorotron or corotron transfer chargers using a corona discharge, and the like.

As the intermediate transfer member 50, a belt-shaped intermediate transfer member (intermediate transfer belt) of semiconductivity-imparted polyimide, polyamide-imide, polycarbonate, polyarylate, polyester, rubber, or the like is used. In addition, examples of the shape of the intermediate transfer member 50 include a drum shape other than the belt shape.

In addition to the above-described devices, the image forming apparatus 100 may be further provided with, for example, an optical erasing device used for optical erasing of the photoreceptor 7 to optical erasing.

In the image forming apparatus 100 shown in FIG. 8, the surface of the photoreceptor 7 is charged by the charging device 8 and an electrostatic latent image is formed by the exposure device 9. Then, the electrostatic latent image on the surface of the photoreceptor 7 is developed as a toner image with the toner in the developing device 11. The toner image on the photoreceptor 7 is transferred onto an intermediate transfer belt 50, and then transferred onto the surface of a recording medium (not shown). Thereafter, the toner image is fixed by a fixing device (not shown).

In a monochrome image forming apparatus, a recording medium is transported to a position where the transfer device 40 and the photoreceptor 7 face each other by a recording medium transport belt, a recording medium transport roller, or the like in place of the intermediate transfer belt 50, and the toner image is transferred onto the recording medium and then fixed.

Figure 9:
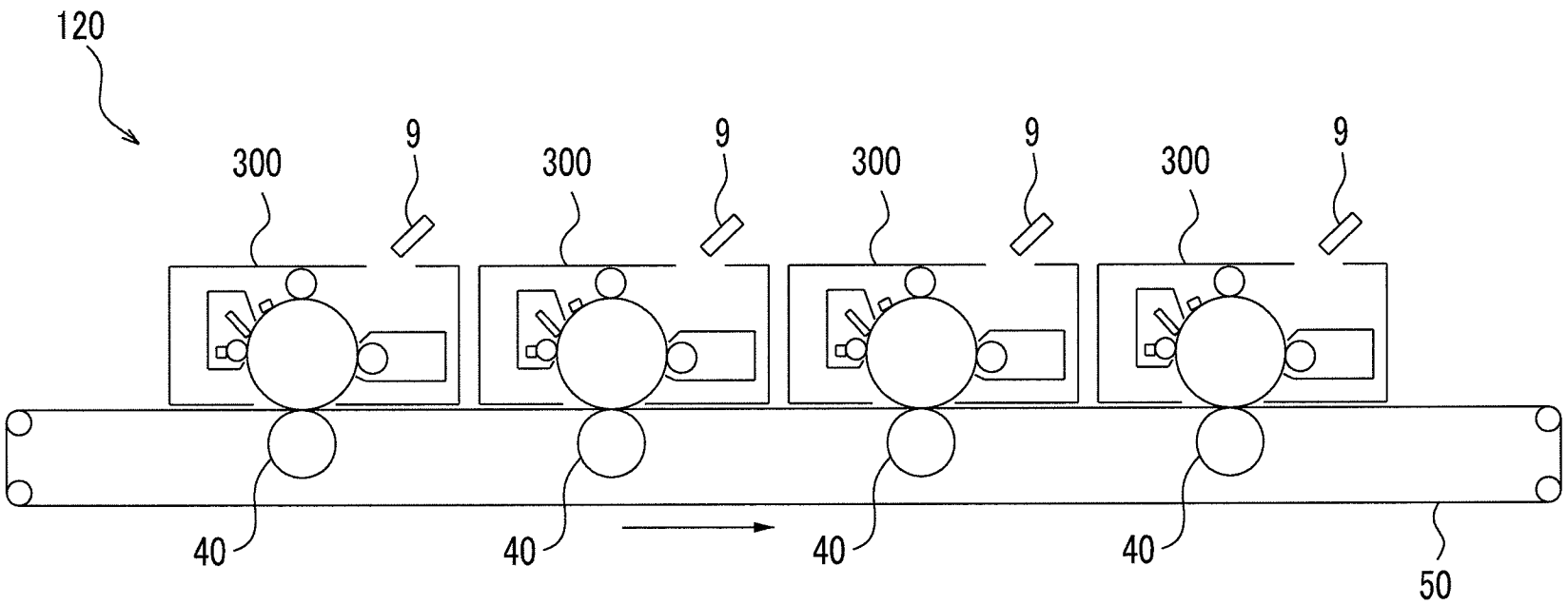
FIG. 9 is a schematic diagram illustrating the configuration of another example of the image forming apparatus according to the exemplary embodiment.

FIG. 9 is a schematic diagram illustrating the configuration of an image forming apparatus according to another exemplary embodiment. As shown in FIG. 9, an image forming apparatus 120 is a tandem-type multicolor image forming apparatus having four process cartridges 300 mounted thereon. In the image forming apparatus 120, the four process cartridges 300 are disposed in parallel to each other on an intermediate transfer member 50, and one electrophotographic photoreceptor is used for one color. The image forming apparatus 120 has the same configuration as that of the image forming apparatus 100, except for being a tandem type.

EXAMPLES

Hereinafter, Examples of the invention will be described, but the invention is not limited to the following Examples.

Preparation of Support

A Φ28-mm cylindrical tube made of aluminum is prepared through impact pressing and subjected to ironing to prepare a Φ24-mm cylindrical tube.

Regarding areas of crystal particles, the particle diameter is adjusted by the number of ironing operations or annealing in an electric oven.

A sample obtained from the cylindrical tube (substrate) is embedded with an epoxy resin and then abraded as follows using an abrader to measure an average area of crystal particles. First, the abrasion is performed using water-resistant abrasion paper #500, and then mirror finishing is performed through buffing. The cross-section of the substrate is observed using a VE SEM manufactured by KEYENCE and the measurement is performed.

Specifically, the above-described sample is prepared at four points (total 4×3=12) at intervals of 90 degrees in a circumferential direction at positions which are respectively distant from upper and lower ends of the cylindrical tube in an axial direction by 5 mm and at the center of the cylindrical tube in the axial direction.

In the cross-section of the sample, the areas of crystal particles present in a range of 30 μm in the axial direction×20 μm in a thickness direction from the outer circumferential surface of the substrate and the areas of crystal particles present in a range of 30 μm in the axial direction×20 μm in the thickness direction from the inner circumferential surface of the substrate are obtained using image processing software which is standard-installed on the VE SEM manufactured by KEYENCE and number-averaged to obtain an average area.

Support 1

As a slag, a JIS A1050-type (aluminum (AL), purity: 99.5%) slag is used to prepare a cylindrical tube support made of aluminum through impact pressing and ironing (the number of ironing operations: 3).

Accordingly, a cylindrical tube support made of aluminum in which the average crystal particle area of the aluminum is 0.69 $\mu m^2$ in an outer circumferential surface and is 2.27 $\mu m^2$ in an inner circumferential surface and the ratio of the average area of the crystal particles of the outer circumferential surface to the average area of the crystal particles of the inner circumferential surface is 30% is prepared.

Supports 2 to 5

Cylindrical tube supports made of aluminum are prepared in the same manner as in the case of the support 1, except that the condition and thickness in the preparation of the support 1 are changed as shown in Table 1.

Support 6

A cylindrical tube support made of aluminum is prepared in the same manner as in the case of the support 1, except that an A3003-type aluminum alloy is used as a slag.

Support 7

The surface of a cylindrical tube made of aluminum which is prepared using a conventional drawn tube is cut to prepare a Φ24-mm cylindrical tube support made of aluminum which has a thickness of 0.4 mm.

Supports 8 to 10 and 12

Cylindrical tube supports made of aluminum are prepared in the same manner as in the case of the support 1, except that the annealing condition in the preparation of the support 1 is changed as shown in Table 1.

Support 11

A cylindrical tube support made of aluminum is prepared in the same manner as in the case of the support 1, except that the ironing condition and the annealing condition in the preparation of the support 1 are changed as shown in Table 1.

Formation of Undercoat Layer 100 parts by weight of a zinc oxide (average particle diameter: 70 nm, manufactured by Tayca Corporation, specific surface area value: 15 $m^2/g$) is mixed and stirred with 500 parts by weight of tetrahydrofuran, and 1.3 parts by weight of a silane coupling agent (KBM503, manufactured by Shin-Etsu Chemical Co., Ltd.) is added thereto and the resultant is stirred for 2 hours. Thereafter, the tetrahydrofuran is distilled away by distillation under reduced pressure and baking is performed at 120° C. for 3 hours to obtain a zinc oxide surface-treated with the silane coupling agent.

110 parts by weight of the surface-treated zinc oxide is mixed and stirred with 500 parts by weight of tetrahydrofuran, and a solution obtained by dissolving 0.6 parts by weight of alizarin in 50 parts by weight of tetrahydrofuran is added thereto and the resultant is stirred for 5 hours at 50° C. Thereafter, the alizarin-imparted zinc oxide is filtered by filtration under reduced pressure and dried under reduced pressure at 60° C. to obtain an alizarin-imparted zinc oxide.

38 parts by weight of a solution obtained by dissolving 60 parts by weight of the alizarin-imparted zinc oxide, 13.5 parts by weight of a curing agent (blocked isocyanate SUMIDUR 3175, manufactured by Sumitomo Bayer Urethane Co., Ltd.), and 15 parts by weight of a butyral resin (S-LEC BM-1, manufactured by Sekisui Chemical Co., Ltd.) in 85 parts by weight of methyl ethyl ketone is mixed with 25 parts by weight of methyl ethyl ketone. The mixture is dispersed for 2 hours with a sand mill using 1-mmϕ glass beads to obtain a dispersion.

To the obtained dispersion, 0.005 part by weight of dioctyltin dilaurate and 45 parts by weight of silicone resin particles (TOSPEARL 145, manufactured by GE-Toshiba Silicone Co., Ltd.) are added as catalysts, whereby a coating liquid for undercoat layer formation is obtained. The coating liquid is coated on the above-described respective supports through a dip coating method, and cured by drying at 170° C. for 30 minutes, whereby an undercoat layer having a thickness of 23 μm is obtained.

Formation of Charge Generation Layer

Next, 1 part by weight of hydroxygallium phthalocyanine having strong diffraction peaks at Bragg angles (2θ±0.2) of 7.5°, 9.9°, 12.5°, 16.3°, 18.6°, 25.1°, and 28.3° in an X-ray diffraction spectrum is mixed with 1 part by weight of polyvinyl butyral (S-LEC BM-S, manufactured by Sekisui Chemical Co., Ltd.) and 80 parts by weight of n-butyl acetate, and this mixture is dispersed for 1 hour using a paint shaker with glass beads to prepare a coating liquid for charge generation layer formation. The obtained coating liquid is dip-coated on a conductive support having an anodized film formed thereon, and heated and dried for 10 minutes at 100° C. to form a charge generation layer having a thickness of about 0.15 μm.

Formation of Charge Transport Layer

Next, a coating liquid for charge transport layer formation is prepared by dissolving 2.6 parts by weight of a benzidine compound represented by the following Formula (CT-1) and 3 parts by weight of a polymer compound (viscosity average molecular weight: 40,000) having repeating units represented by the following Formula (B-1) in 25 parts by weight of THF. The obtained coating liquid is coated on the above-described charge generation layer through a dip coating method and heating is performed thereon for 45 minutes at 130° C. to form a charge transport layer having a thickness of 20 μm. Accordingly, an electrophotographic photoreceptor is prepared.

(CT-1)

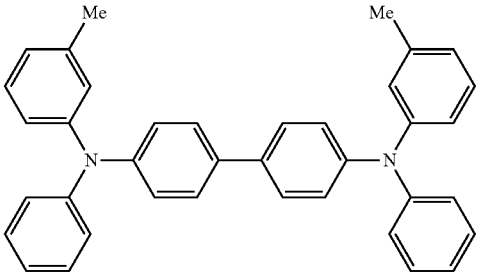

(B-1)

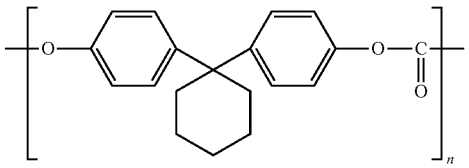

Evaluation

Drop Test

The photoreceptors prepared in Examples and Comparative Examples are mounted on a process cartridge of a color image forming apparatus (manufactured by Fuji Xerox Co., Ltd., C1100) and are allowed to collide with a floor surface by free drop from a drop height of 1.5 m from the floor surface. Regarding the deformation of the conductive support, the circularity is measured using RONDCOM 60A manufactured by Tokyo Seimitsu Co., Ltd. and visually confirmed.

Thereafter, these were mounted on a printer to output images having a half-tone density of 50% to A4 paper (manufactured by Fuji Xerox Co., Ltd., C2 paper). Thereafter, a letter image having an area coverage (ratio of area occupied by letters in A4 paper) of 2% is output on 20,000 pieces of A4 paper (manufactured by Fuji Xerox Co., Ltd., C2 paper) to confirm the image and problems in practical use.

Deformation Amount

A: There is no change in circularity. There are no problems.

B: There are no problems in practical use even with a deterioration in circularity by 30 μm or less as compared before the drop.

C: There are no problems in practical use even with a deterioration in circularity by greater than 30 μm to 100 μm as compared before the drop.

D: The circularity deteriorates by greater than 100 μm as compared before the drop.

Image Quality

A: There are no problems.

B: There are no problems in practical use even with a change in image density.

C: An obvious reduction in image density is caused in the image after output of 20,000 pieces of paper.

D: Voids due to deformation are caused from first paper.

The results are shown in the following Table 1.

TABLE 1

| | Configuration of Substrate (Support) | | | | | | | | Evaluation Results | |
|---|---|---|---|---|---|---|---|---|---|---|
| | | | | Average Area of Crystal Particles | | | | | | |
| | Support | AL Purity [%] | Thickness [mm] | Outer Circumferential Surface [μm²] | Inner Circumferential Surface [μm²] | Working Method | Number of Ironing Operations | Annealing Temperature/Time | Deformation Amount | Image Quality |
| Example 1 | Support 1 | 99.5 | 0.40 | 0.69 | 2.27 | Impact Pressing + Ironing | 3 | None | A | A |
| Example 2 | Support 2 | 99.5 | 0.40 | 1.74 | 4.54 | Impact Pressing + Ironing | 2 | None | A | A |
| Example 3 | Support 3 | 99.5 | 0.40 | 1.25 | 2.76 | Impact Pressing + Ironing | 1 | None | B | A |
| Example 4 | Support 6 | 97.3 | 0.40 | 0.28 | 1.13 | Impact Pressing + Ironing | 3 | None | C | B |
| Example 5 | Support 8 | 99.5 | 0.40 | 1.39 | 4.54 | Impact Pressing + Ironing | 3 | 200° C./1.0 hr | C | B |
| Example 6 | Support 9 | 99.5 | 0.40 | 0.97 | 2.50 | Impact Pressing + Ironing | 3 | 150° C./1.0 hr | B | A |
| Example 7 | Support 10 | 99.5 | 0.40 | 1.04 | 2.72 | Impact Pressing + Ironing | 3 | 150° C./0.5 hr | A | A |
| Example 8 | Support 4 | 99.5 | 0.30 | 0.56 | 2.50 | Impact Pressing + Ironing | 3 | None | B | A |
| Example 9 | Support 5 | 99.5 | 0.90 | 0.76 | 3.78 | Impact Pressing + Ironing | 3 | None | A | A |
| Comparative Example 1 | Support 7 | 98.0 | 0.40 | 1.13 | 0.97 | Drawn Tube + Cutting | 0 | None | C | C |
| Comparative Example 2 | Support 11 | 99.5 | 0.40 | 6.62 | 6.31 | Impact Pressing + Ironing | 1 | 200° C./3.0 hr | D | D |
| Comparative Example 3 | Support 12 | 99.5 | 0.40 | 7.32 | 7.22 | Impact Pressing + Ironing | 3 | 300° C./2.0 hr | D | D |

As shown in Table 1, it is found that the conductive supports of Examples are suppressed from being deformed by drop impact, and even when various transport impacts are received, image defects are suppressed.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A cylindrical member which includes aluminum and in which an average area of crystal particles of an outer circumferential surface is smaller than an average area of crystal particles of an inner circumferential surface.

2. The cylindrical member according to claim 1,
wherein a ratio (S1/S2×100) of the average area S1 of crystal particles of the outer circumferential surface to the average area S2 of crystal particles of the inner circumferential surface is from 20% to 45%.

3. The cylindrical member according to claim 1,
wherein a ratio (S1/S2×100) of the average area S1 of crystal particles of the outer circumferential surface to the average area S2 of crystal particles of the inner circumferential surface is from 24% to 38%.

4. The cylindrical member according to claim 1,
wherein the average area S1 of crystal particles of the outer circumferential surface is from 0.9 $\mu m^2$ to 1.25 $\mu m^2$.

5. The cylindrical member according to claim 1,
wherein the average area S2 of crystal particles of the inner circumferential surface is from 2.76 $\mu m^2$ to 4.54 $\mu m^2$.

6. The cylindrical member according to claim 1,
wherein the average area of crystal particles is reduced in a thickness direction from the inner circumferential surface to the outer circumferential surface.

7. The cylindrical member according to claim 1,
wherein an aluminum content is 99.5% or greater.

8. The cylindrical member according to claim 1,
wherein an aluminum content is 99.6% or greater.

9. The cylindrical member according to claim 1,
wherein the cylindrical member has a thickness of from 0.3 mm to 0.9 mm.

10. The cylindrical member according to claim 1,
wherein the cylindrical member has a thickness of from 0.4 mm to 0.6 mm.

11. A cylindrical member for an image forming apparatus which is used in the image forming apparatus, comprising:
the cylindrical member according to claim 1; and
a resin layer or a rubber layer which is disposed on an outer circumferential surface of the cylindrical member.

12. An electrophotographic photoreceptor comprising:
the cylindrical member for an image forming apparatus according to claim 11.

13. An image forming apparatus comprising:
the cylindrical member for an image forming apparatus according to claim 11.

14. An image forming apparatus comprising:
the electrophotographic photoreceptor according to claim 12;
a charging unit that charges a surface of the electrophotographic photoreceptor;
an electrostatic latent image forming unit that forms an electrostatic latent image on the surface of a charged electrophotographic photoreceptor;
a developing unit that develops the electrostatic latent image formed on the surface of the electrophotographic photoreceptor with a developer including a toner to form a toner image; and
a transfer unit that transfers the toner image formed on the surface of the electrophotographic photoreceptor onto a recording medium.

15. A process cartridge that is detachable from an image forming apparatus, comprising:
the cylindrical member for an image forming apparatus according to claim 11.

16. A process cartridge that is detachable from an image forming apparatus, comprising:
the electrophotographic photoreceptor according to claim 12.

* * * * *